United States Patent [19]

Beachy et al.

[11] Patent Number: 5,001,611

[45] Date of Patent: Mar. 19, 1991

[54] VERSATILE LIGHT FIXTURE

[75] Inventors: Robert W. Beachy, Saint Paul; Jay J. Kakuk, Plymouth; Steven T. O'Brien, Champlin, all of Minn.

[73] Assignee: The Toro Company, Minneapolis, Minn.

[21] Appl. No.: 392,671

[22] Filed: Aug. 11, 1989

[51] Int. Cl.[5] ..... F21S 1/02

[52] U.S. Cl. ..... 362/145; 362/368; 362/432

[58] Field of Search ..... 362/145, 147, 152, 285, 362/147, 362, 367, 368, 370, 371, 418, 430, 431, 432

[56] References Cited

U.S. PATENT DOCUMENTS

| | | | |
|---|---|---|---|
| D. 301,757 | 6/1989 | Hanson | D26/68 |
| 3,014,126 | 12/1961 | Endelson | 362/370 |
| 3,318,060 | 5/1967 | Bartley | 362/432 |
| 4,338,653 | 7/1982 | Marrero | 362/217 |
| 4,384,316 | 5/1983 | de Vos et al. | 362/431 |
| 4,414,611 | 11/1983 | Seltzer et al. | 362/362 |
| 4,535,393 | 8/1985 | Aspenwall | 362/217 |
| 4,747,025 | 5/1988 | Barton | 362/285 |
| 4,774,648 | 9/1988 | Kakuk et al. | 362/302 |
| 4,814,961 | 3/1989 | O'Brien et al. | 362/319 |
| 4,870,548 | 9/1989 | Beachy et al. | 362/145 |
| 4,888,669 | 12/1989 | Hanson | 362/371 |

FOREIGN PATENT DOCUMENTS

| | | | |
|---|---|---|---|
| 462749 | 11/1968 | Switzerland | 362/370 |

OTHER PUBLICATIONS

Design patent application entitled "Light Fixture", filed 7/21/89 as Ser. No. 07/383,968 and assigned to the assignee of the present application.

Brochure entitled "TerraDek Lights: Low Voltage Wood Lighting for Decks, Patios, Pools, Stairways and Walkways," by TerraLight Systems, form MH-1013-61-5, ©1989.

Brochure entitled "Low Voltage Wood Deck Light Set," by Intermatic Inc., Form LVC 1000-J, ©1988.

Brochure entitled "We Light The Night," by Minnfac, Inc., ©1988.

*Primary Examiner*—Ira S. Lazarus
*Assistant Examiner*—Richard R. Cole
*Attorney, Agent, or Firm*—R. Lawrence Buckley

[57] ABSTRACT

A deck light (20) including a post (22), cap (24) and lamp/lens assembly (26). Lamp/lens assembly (26) independently attaches to post (22) and cap (24) so that lamp/lens assembly (26) can be removed and separately attached to a deck member; or, alternatively, either post (22) or cap (24), or both, can be attached to lamp/lens assembly (26) and the combination can be attached in a variety of ways to the deck. Preferably, lamp/lens assembly (26) is about 3½ inches wide and about 1½ inches deep so that it (either alone or in combination with post (22) and/or cap (24) can be flush mounted to various deck members in a variety of ways. In a preferred embodiment, a stake (100) can be attached to the bottom of post (22) so that fixture (20) can even be used as a stake light.

9 Claims, 5 Drawing Sheets

VERSATILE LIGHT FIXTURE

FIELD OF THE INVENTION

Broadly, the invention relates to light fixtures. More particularly, preferred embodiments of the invention include low voltage outdoor light fixtures.

BACKGROUND OF THE INVENTION

Light fixtures can be categorized in many different ways. For example, there are indoor light fixtures and outdoor light fixtures; and there are "low" voltage (typically 12 VAC) and "line" voltage (typically 110 VAC) fixtures. Although those skilled in the art will recognize that the present invention could certainly be applied to indoor and/or line voltage fixtures, for the sake of brevity the following discussion will focus on outdoor low voltage light fixtures.

Although there is a tremendous variety of outdoor low voltage light fixtures, for purposes of the present discussion such fixtures can be divided into two very broad classes, namely "ground" lights and "deck" lights. A "ground" light is defined herein as an outdoor low voltage light which can be secured to the ground, usually by means of a pointed stake or the like. Examples include temple lights, flood lights, path lights and post lights.

Deck lights, the other type of outdoor low voltage lights, are designed to attach to and illuminate wooden steps or decks, for example. Reference is made to deck lights produced by Intermatic and MinnFac. Such deck lights include wooden "posts" or other supports which carry lamp/lens assemblies. The posts can be nailed or screwed to any wooden structure.

There are unquestionably many different applications for outdoor low voltage lights. They can be called upon to illuminate bushes, flowers, gardens, walkways, landscaping details such as fountains, and architectural details such as doors and steps.

In view of the wide range of applications for outdoor low voltage lights, attempts have been made to render "ground" lights adjustable or adaptable. For example, see U.S. Pat. No. 4,774,648, assigned to the assignee herein, which shows a temple light, the baffles and cap of which can be removed or added to create various lighting effects. Reference is also made to U.S. patent application Ser. No. 201,713, filed June 3, 1988, assigned to the assignee herein, which shows a flood/spot light which can be adjusted to produce a broad beam (in the floodlight mode) or a fairly narrow beam (in the spotlight mode). Post lights have been made adjustable as well. Reference is made to U.S. Pat. No. 4,814,961, still another Toro patent which discloses a post light, wherein the number and spacing of the baffles or louvers can be adjusted to create various aesthetic effects.

Although adjustability and adaptability have been designed into some "ground" lights, as discussed above, these desirous features or aspects have not been applied to deck lights. For example, the Intermatic and MinnFac deck lights can be mounted in only a limited number of ways, to fit a small number of applications. Although these lights are useful for their intended purposes, they are not sufficiently flexible or adaptable to meet the many possible uses of deck lights. Such uses would include being mounted to deck posts, steps, deck edges, rails, landscape timbers, walls, etc., in a variety of orientations to throw light upwardly, downwardly and laterally.

The present invention is particularly directed to an extremely versatile deck light. The deck light of the present invention can be easily adapted to mount to deck posts, steps, deck edges, rails, etc., so as to be useful in a wide variety of deck lighting applications. In fact, in a preferred embodiment the deck light of the present invention can even be configured as a "ground" light.

SUMMARY OF THE INVENTION

Accordingly, the invention includes a versatile light fixture suitable for connection to a variety of deck members, including a lamp/lens assembly; and a support structure for detachably carrying the lamp/lens assembly, wherein the light fixture as a whole or the lamp/lens assembly alone can be connected to the deck members in a variety of ways.

Another aspect of the invention is that the light fixture should be about 3½ inches wide and about 1½ inches deep, whereby the light fixture can flush mount to a variety of 2-by-4 and 4-by-4 deck members.

BRIEF DESCRIPTION OF THE DRAWING

The invention will be further described with reference to the appended Drawing, in which.

DETAILED DESCRIPTION OF PREFERRED EMBODIMENT

Figure 3:
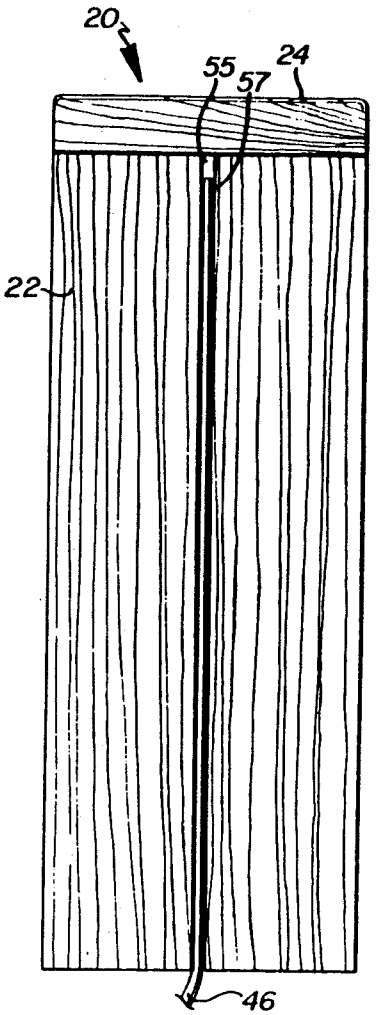
FIG. 3 is a rear elevational view thereof.
Figure 2:
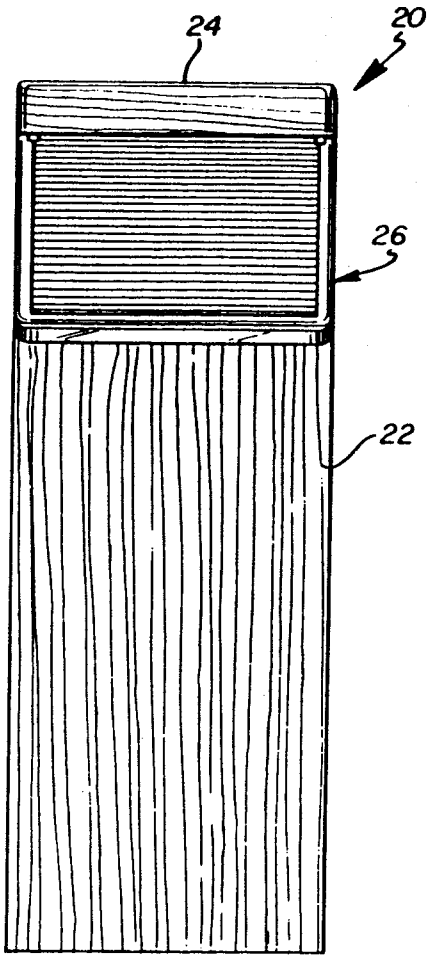
FIG. 2 is a front elevational view thereof.
Figure 1:
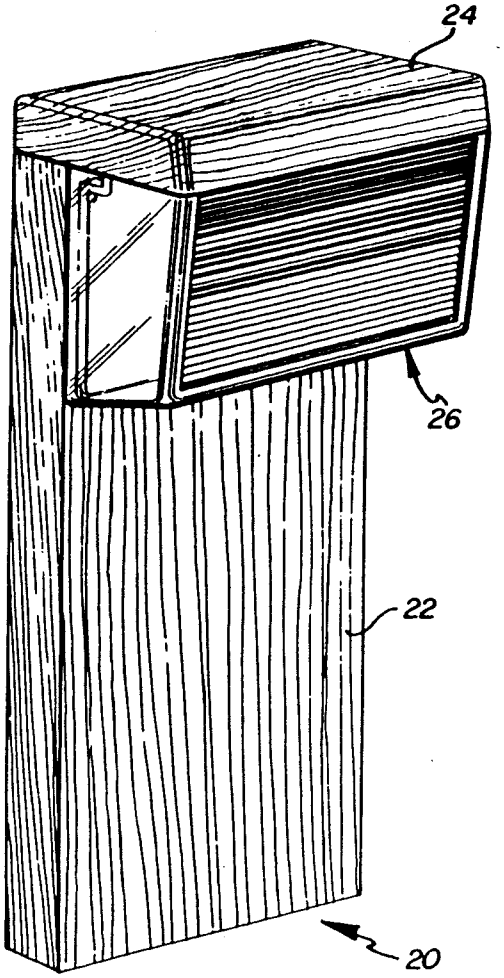
FIG. 1 is a perspective view of a preferred light fixture according to the present invention.
Figure 6:
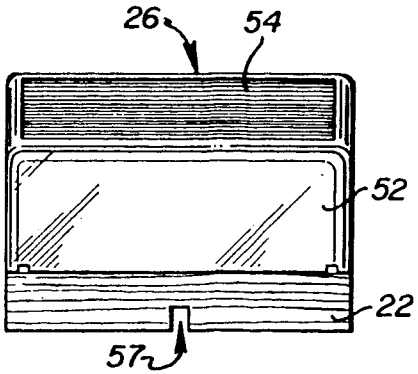
FIG. 6 is a bottom plan view thereof.
Figure 5:
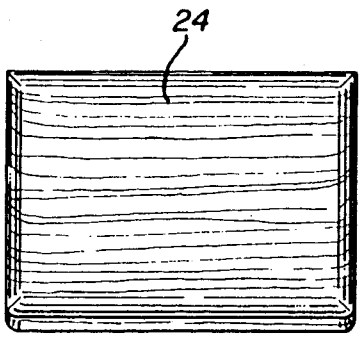
FIG. 5 is a top plan view thereof.
Figure 4:
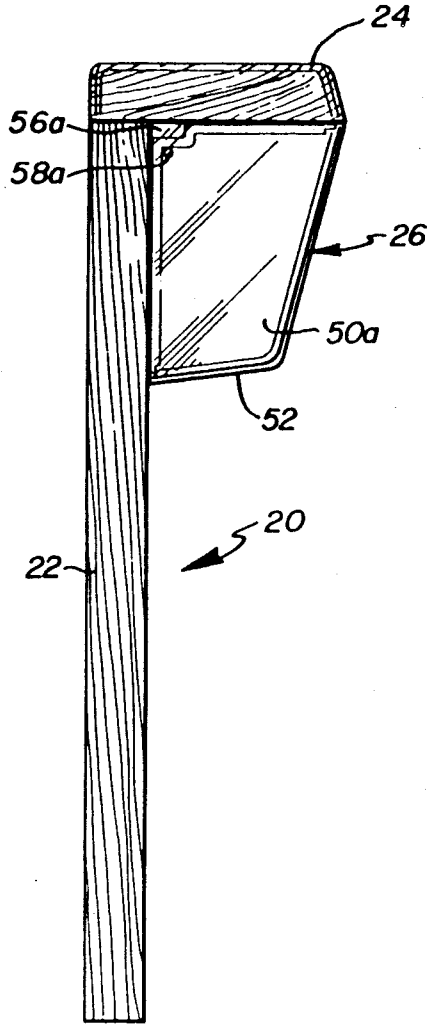
FIG. 4 is a side elevational view thereof.

Referring to the Drawing, wherein like reference numerals designate like parts and assemblies throughout the several views, FIG. 1 is a perspective view of a preferred light fixture 20 according to the present invention. Light fixture 20 includes an elongate post 22 at the top of which is located a forwardly-extending cap 24. Post 22 and cap 24 combine to form an inverted L-shaped structure, the angle between post 22 and cap 24 preferably being about 90°. Mounted to the front surface of post 22 and the bottom surface of cap 24 is a lamp/lens assembly 26. Although cap 24 could be connected directly to post 22, in the preferred embodiment shown and described herein post 22 and cap 24 are separately connected to lamp/lens assembly 26, but are not connected directly together. Preferably, post 22 and cap 24 are made of wood, e.g., redwood. These wooden components can be stained or painted to match most any other wood surface. By contrast, lamp/lens assembly 26 is substantially made of a high grade transparent or translucent plastic, preferably polycarbonate, which is frosted in the preferred fixture. As described below there are components of lamp/lens assembly 26 which are not made of plastic, but for the most part lamp/lens assembly 26, in its preferred form, is indeed made of injection molded plastic.

Figure 7:
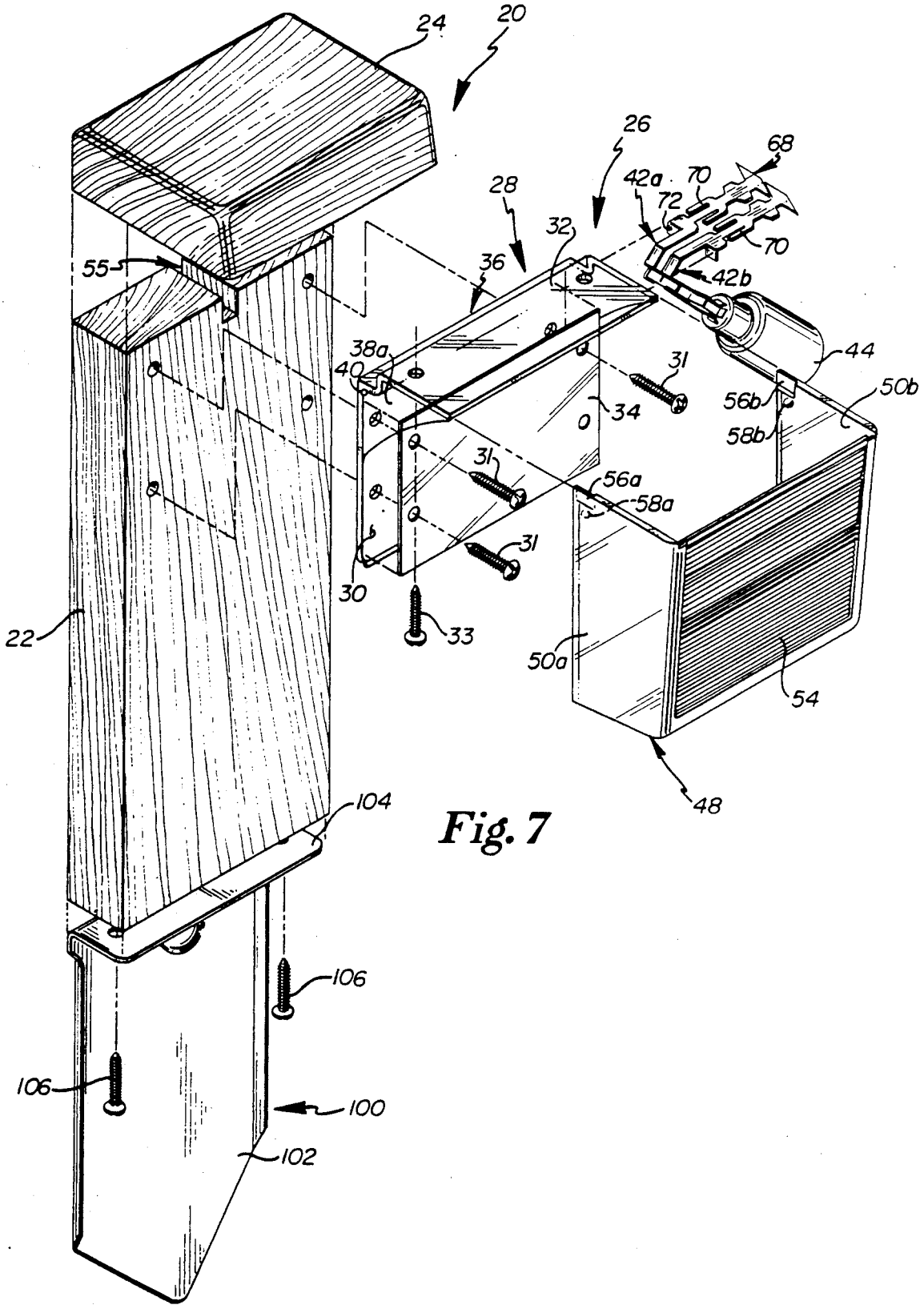
FIG. 7 is an exploded view thereof, not including the electrical cable.

Referring to FIG. 7, lamp/lens assembly 26 includes a roughly L-shaped backplate 28 which has a substantially rectangular long section 30 and, perpendicular thereto, a short section 32. When fixture 20 is oriented in the manner shown in FIG. 7, long section 30 is vertical and short section 32 is horizontal. Sections 30 and 32 are secured by wood screws 31 and 33, respectively to post 22 and cap 24. Thus, the planar rear surface of backplate long section 30 lies against the upper front surface of post 22; and the top surface of backplate short section 32 lies in contact with the bottom front surface of cap 24.

An aluminum reflector 34 is supported by and lies against the front surface of backplate long section 30. Reflector 34 is also secured by wood screws 31.

Although backplate 28 is generally in the nature of an inverted "L," there is actually, in the preferred embodiment, a small rectangular channel 36 formed at the juncture between backplate sections 30 and 32. Channel 36 receives and guides the electrical cable for the light in certain situations, as described further below. Strengthening the connection between backplate portions 30 and 32 is a pair of roughly triangular braces **38*a* and 38*b* located at the laterally-spaced outer edges of backplate 28. Extending outwardly from each brace 38, and immediately below channel 36, is a small rounded projection 40**, the function of which is described below.

Figure 8:
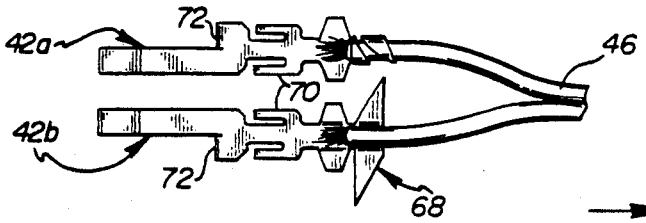
FIG. 8 is a top plan view of the lamp contacts of the light fixture of FIG. 1, attached to the electrical cable.
Figure 11:
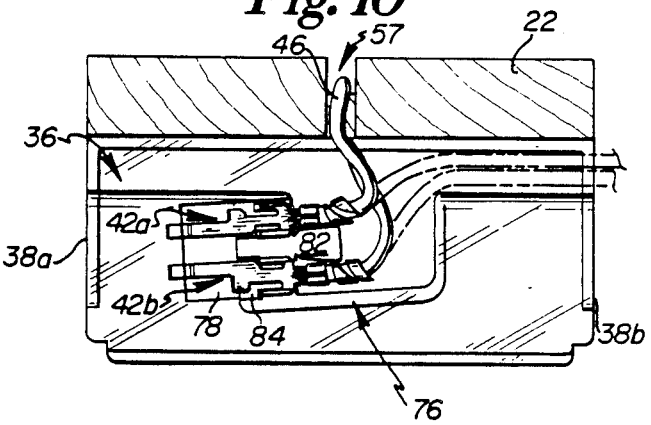
FIG. 11 is a top plan view of the light fixture of FIG. 1 with the cap removed.

Backplate short section 32 supports a pair of lamp contacts **42*a* and 42*b* which in turn support and make electrical contact with a lamp 44: and which are also conductively connected to a cable 46, as shown in FIGS. 8 and 11. For the sake of clarity, FIG. 7 does not show cable 46 or the specific manner in which backplate short section 32 receives lamp contacts 42. Suffice it to say, for the time being, that lamp 44 is supported by lamp contacts 42 in such a way that it hangs beneath backplate short section 32 and in front of backplate long section 30**.

Referring again to FIG. 7, removably mounted to backplate 28 is a somewhat box-shaped lens 48. Lens 48, preferably made of frosted translucent or transparent plastic, includes substantially rectangular right and left walls 50; substantially rectangular bottom wall 52; and a virtually square front wall 54. Front wall 54 includes a plurality of small horizontal ridges on the exterior surface thereof which form, in combination, a Fresnel lens suitable for appropriately focusing the light generated by lamp 44. Those skilled in the art of optics design, and light fixture design in general, are familiar with such light-bending ridges, and no further explanation of them is necessary.

Toward the upper, inner corner of each lens sidewall 50 is a small rectangular removable tab 56. The wall thickness of tabs 56 is reduced to allow them to be selectively broken away through the use of a pair of pliers. If cable 46 is to pass through one side of lamp/lens assembly 26, tab **56*a* is removed, whereas if cable 46 is to pass through the other side, tab 56*b* is removed. Another possibility is to divert cable 46 straight back, first through a horizontal slot 55 is the top end of post 22, and then downwardly through a vertical slot 57 in the rear face of post 22**.

Immediately below each tab 56, formed in the interior surface of each sidewall 50, is a small roughly circular recess 58 sized to receive the corresponding projection 40 extending laterally outwardly from the edge of backplate 28. Lens 48 snaps over backplate 28, thereby completely enclosing lamp 24: at the top by backplate short section 32, at the back by backplate long section 30, at the sides by lens sidewalls 50, at the front by lens front wall 54, and at the bottom by lens bottom wall 52. The rear vertical edges of lens sidewalls 50 bear against the front surface of post 22. To attach lens 48 to backplate 28 it is simply necessary to smoothly push it into position, allowing recesses 58 to snap over and receive corresponding projections 40. To remove lens 48 from backplate 28, lens sidewalls 50 are slightly bowed outwardly to enable projections 40 to escape recesses 58.

Figure 9:
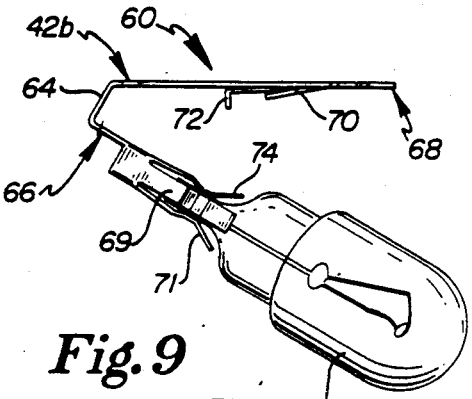
FIG. 9 is a side elevational view of one of the lamp contacts of FIG. 8 operatively connected to the lamp.

FIG. 9 shows an enlarged elevational view of lamp 44 and front lamp contact **42*b*. Rear lamp contact 42*a* is a mirror image of front contact 42*b*, and therefore a description of front contact 42*b*** will suffice for both.

Each lamp contact 42 includes an elongate, normally horizontal upper portion 60; a relatively short spanning portion 64 connected at the left end (as viewed in the Drawing) of portion 60 and extending downwardly and outwardly therefrom; and a lower portion 66 connected to spanning portion 64 at the lower end thereof and being roughly perpendicular thereto. Upper portion 60 includes, at its free or right end, a standard cable crimp structure 68. As well known to those skilled in the art, such a structure can be tightly wrapped about an exposed copper wire to effect mechanical and electrical contact between the two. Angling slightly downwardly from the main plane of upper portion 60, and away from cable crimp structure 68, is a pair of spring members 70. Spring members 70 are in the nature of small rectangular leaf springs which resist any attempt to place them in a coplanar relationship with the main body of portion 60. Functionally related to spring members 70 is a small rectangular stop member 72 which extends vertically downwardly from the main plane of upper portion 60. Stop 72 and spring members 70 combine to secure lamp contact 42 as further described below. Spring members 70 are located between crimp structure 68 and stop 72.

The free end of lower portion 66 of each lamp contact 42 includes three "leaves" which springingly receive the contact portion of lamp 44 to mechanically support lamp 44 and make electrical contact with one of the lamp leads. More specifically, each lamp contact 42 includes a side leaf 69, a bottom leaf 71, and a top leaf 74. This technique for holding a lamp and making contact to its leads is disclosed in U.S. Pat. No. 4,774,648, column 6, lines 39–62, this portion of said patent being incorporated herein by reference. It should be noted that each lamp contact 42 is preferably formed from a single piece of metal, e.g., stainless steel. A standard die stamping fabrication process can be used.

Figure 10:
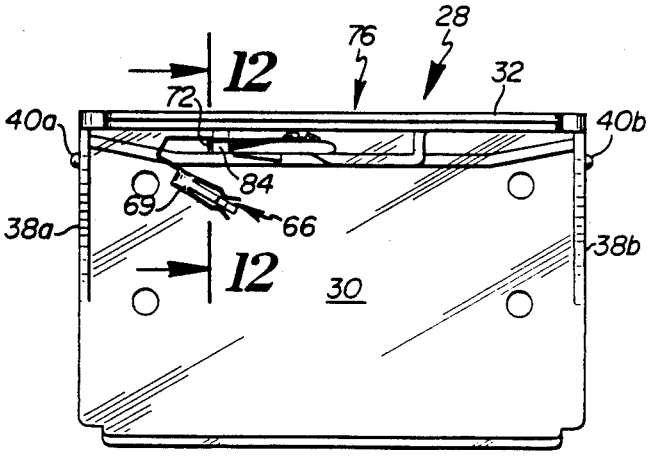
FIG. 10 is a front elevational view of the backplate of the light fixture of FIG. 1.
Figure 12:
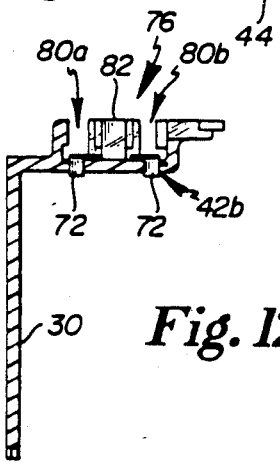
FIG. 12 is a sectional view of the backplate assembly of FIG. 10, taken generally along line 12—12 thereof.

Lamp contacts 42, as noted above, are received by and secured to backplate short section 32. Referring to FIGS. 10, 11 and 12 backplate short section 32 forms a recessed area 76 suitable for receiving lamp contacts 42. Recessed area 76 is generally divided into three sections. Referring to FIG. 11, the leftmost section is actually a rectangular thru aperture 78 in backplate short section 32. Aperture 78 allows the spanning and lower portions 64 and 66, respectively, of lamp contacts 42 to extend beneath the lower surface of backplate short section 32, to position lamp contact leaves 69, 71, 74 as shown in FIG. 10. The central section of recessed portion 76 defines a pair of roughly parallel slots 80 divided by an elongate projection 82 which extends up to the major planar surface of backplate short section 32. The rightmost (as viewed in the Drawing) section of recessed area 76 is a cup-shaped structure which simply acts as a guide for cable 46, giving cable 46 enough room to bend so that it can selectively be diverted to either side of backplate 28 (see FIG. 11, where cable 46 is seen passing through one side of backplate 28), or rearwardly and downwardly through post slots 55 and 57, respectively.

Each lamp contact slot 80 has, at its lowermost extent, a generally planar surface, but toward the leftmost edge of this generally planar surface is a pair of small parallel slots aligned with the overall slot 80, these small slots being sized and positioned to in effect form a small rectangular ridge 84 at the leftmost edge of each slot 80. Ridge 84 is significant in that the stop 72 and spring members 70 of each lamp contact 42 bear against ridge 84 to securely fix the lamp contact 42 to backplate short section 32. To assemble contacts 42 to backplate 28, it is simply necessary to attach contacts 42 to cable 46 using crimp structures 68: position contacts 42 such that the cable ends thereof are adjacent ridges 84 of the slot; and then simply draw cable 46 rightwardly (as viewed in FIGS. 10 and 11) until spring members 70 snap downwardly to bear against the right surfaces of ridges 84 while the stops 72 bear against the left surfaces of ridges 84. Once spring members 70 snap into position, it is extremely difficult to remove contacts 42.

Referring again to FIG. 7, it may be desirous to attach a stake 100 to the bottom end of post 22. Stake 100 can be formed into its preferred inverted "L" shape from a single piece of steel and include a long vertical section 102 with a point at the lower end thereof, and a short horizontal section 104 perpendicular thereto. Short section 104 can be apertured to receive a pair of wood screws 106 to secure stake 100 to the lower end of post 22.

Having described the preferred structure for light fixture 20, the discussion can now focus on the versatility and operation of the fixture. As noted above, fixture 20 can be used as a simple yard or path light by attaching stake 100 thereto (see FIG. 7) and simply pushing stake 100 into the ground to secure fixture 20 such that post 22 is in an upright orientation. In this case, cable 46 would normally be routed rearwardly and downwardly through post slots 55 and 57, as shown in solid line in FIG. 11. Cable 46 would be attached, typically, to perhaps other similar light fixtures and ultimately to a low voltage (12 VAC) power pack, which is line voltage driven.

Figure 13:
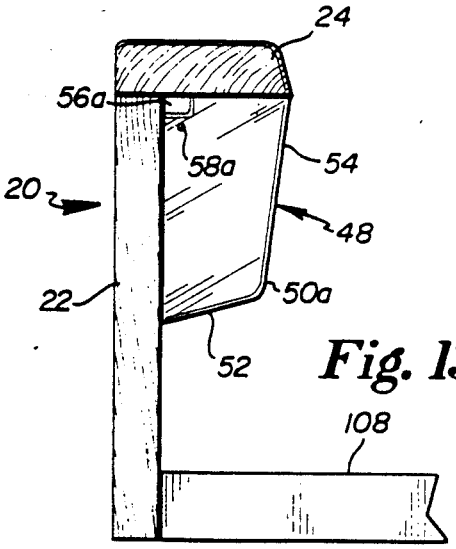
FIG. 13 is a side elevational view of the light fixture of FIG. 1 attached to, for example, the edge of a deck.
Figure 14:
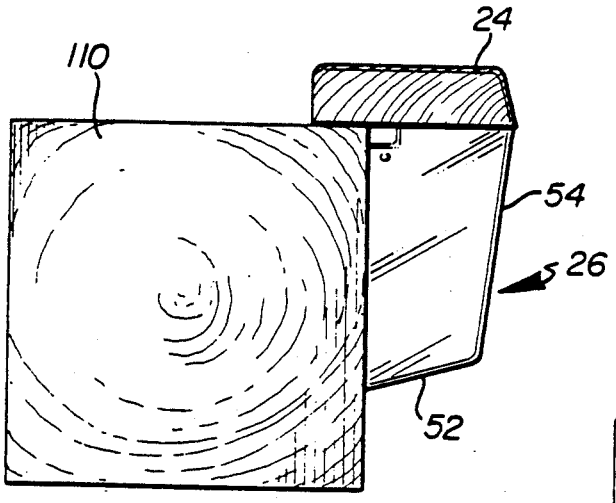
FIG. 14 is a side elevational view of a first modified version of the light fixture of FIG. 1 attached to a landscape timber.

FIG. 13 shows another very common application. In this case, post 22 is nailed or screwed to the edge of a horizontal member 108 which could be, for example, a deck. FIG. 14 shows an application wherein post 22 is omitted altogether. As noted above, post 22 and cap 24 are separately and independently attached to lamp/lens assembly 26, and therefore post 22 can be removed without affecting the mechanical integrity of the structure. In FIG. 14, backplate short section 32 is attached, typically by screws, to a landscape timber 110. Here, cable 46 would be routed to one side or the other of lamp/lens assembly 26. In FIG. 11, cable 46 is shown in dashed line exiting lamp/lens assembly 26 to one side. Cable 46 could similarly be routed so as to pass through the other side of lamp/lens assembly 26. It is simply necessary to remove tab 56 on the appropriate lens sidewall 50 to allow cable 46 to pass therethrough.

Figure 15:
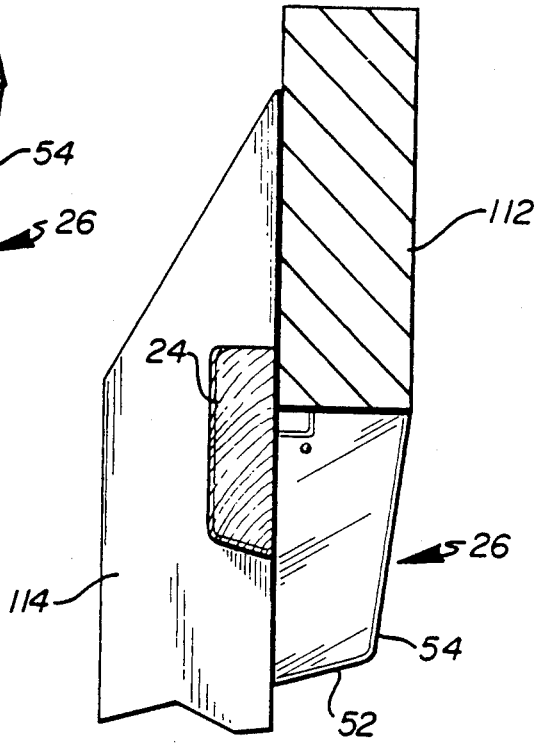
FIG. 15 is a side elevational view of a second modified version of the light fixture of FIG. 1 attached to the underside of a deck rail.

FIG. 15 shows light fixture 20 again being used without its post 22. Here, cap 24 is actually mounted to backplate long section 30, rather than backplate short section 32 as was the case in the applications discussed above. To get the offset effect shown in FIG. 15, cap 24 is attached to backplate long section 30 using the upper holes thereof (see FIG. 7). It is unnecessary to drill new holes in cap 24 or backplate long section 30. Referring again to FIG. 15, this configuration might be used to provide "backlighting" under a 2-by-4 horizontal rail 112. The member designated with reference number 114 might represent a vertical post supporting rail 112. Here, cable 46 would be routed to one side or the other of fixture 20 using channel 36 and one of the breakaway tabs 56. Backplate short section 32 would be attached to the underside of rail 112, using wood screws.

Figure 16:
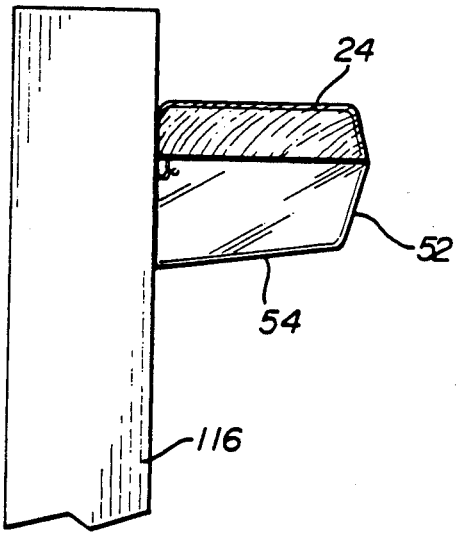
FIG. 16 is a side elevational view of a third modified version of the light fixture of FIG. 1 attached to a post or wall.

FIG. 16 shows still another way to configure fixture 20, such that it can be cantilevered from a wall or post 116. In this case, cap 24 is secured to backplate long section 30, and backplate short section 32 is placed against vertical member 116. Screws through backplate short section 32 secure lamp/lens assembly 26 to vertical member 116. Cable 46 would be routed to one side or the other of lamp/lens assembly 26 using channel 36 and the appropriate breakaway tab 56.

Figure 17:
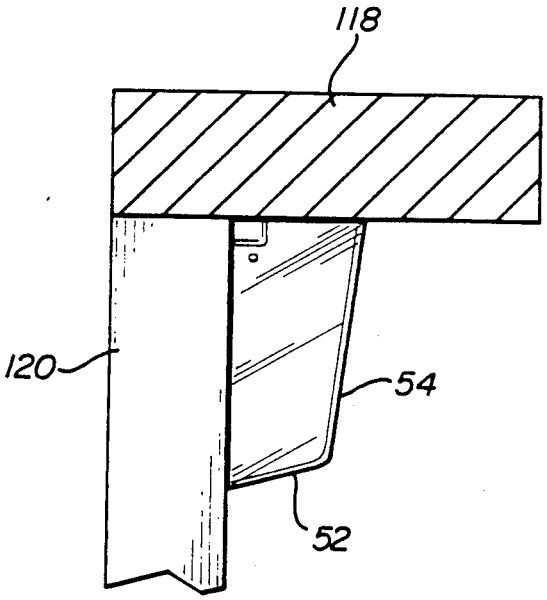
FIG. 17 is a side elevational view of the lamp/lens assembly, alone, of the light fixture of FIG. 1, mounted beneath a deck rail.

FIG. 17 shows still another way to use light fixture 20, or at least lamp/lens assemblY 26 of same. In this case, wood components 22, 24 of the fixture are not used. This technique might be useful for providing backlighting under a horizontal rail. That is, a rail 118 might be supported by a 2-by-4 post 120. Lamp/lens assembly 26 could be secured both to post 120 and rail 118, and cable 46 could be routed to one side or the other of the fixture.

It should be noted that fixture 20 is a little less than about 3½ inches wide and lamp/lens assembly 26 is a little less than about 1½ inches deep so that fixture 20, or lamp/lens assembly 26, can be mounted flush with 2-by-4 or 4-by-4 wooden members in various orientations.

There are other modifications which will be apparent to those skilled in the art. Accordingly, the scope of this invention will be limited only by the appended claims.

We claim:

1. A light fixture, comprising:
(a) an elongate post;
(b) a cap; and
(c) a lamp/lens assembly comprising:
(i) a backplate having first and second generally perpendicular sections; and
(ii) a lens removably connected to the backplate, wherein the first backplate section is configured for connection to the post and the second backplate section is configured for connection to the cap, and the cap and post are not secured to one another, whereby the cap and the lamp/lens assembly can be used in combination with one another, independent of the post, or the lamp/lens assembly can be used by itself, independent of the cap and the post.

2. A light fixture suitable for connection to a deck member, comprising:

(a) a support structure suitable for connection to the deck member;

(b) a lamp/lens assembly comprising:

(i) a backplate suitable for connection to the support structure, the backplate comprising first and second substantially perpendicular sides, and the support structure comprising a post suitable for connection to the deck member, wherein the first side of the backplate is configured for removable connection to the post;

(ii) a pair of lamp contacts operatively supported by the backplate;

(iii) a lamp mechanically and electrically connected to the lamp contacts; and (iv) a lens removably connected to the backplate, wherein the backplate can be connected from the support structure or disconnected from the support structure and connected directly to the deck member; and (c) the support structure further comprising a cap, the cap and the post combining to form a substantially L-shaped structure, wherein the second side of the backplate is configured for removable connection to the cap.

3. A light fixture, comprising:

(a) an elongate post;

(b) a cap;

(c) a lamp/lens assembly having first and second substantially perpendicular sides, wherein the lamp/lens assembly can be supported in at least three ways, namely:

(i) by the elongate post and the cap, wherein the post and the cap combine to form a first substantially L-shaped structure and the first side of the lamp/lens assembly is adjacent the front of the post and the second side of the lamp/lens assembly is adjacent the bottom of the cap;

(ii) by the cap and a deck member, wherein the deck member and the cap combine to form a second substantially L-shaped structure and one side of the lamp/lens assembly is adjacent the deck member and the other side of the lamp/lens assembly is adjacent the cap; and (iii) by a pair of deck members which combine to form a third substantially L-shaped structure, wherein one side of the lamp/lens assembly is adjacent one of the deck members and the other side of the lamp/lens assembly is adjacent the other deck member.

4. A lamp/lens assembly for a light fixture, comprising:

(a) a plastic backplate having first and second generally perpendicular sides, each side being apertured to receive wood screws;

(b) a four-sided light-transmitting plastic lens removably connected to the backplate, wherein the backplate and the lens combine to form a plastic box-like light-transmitting structure;

(c) a pair of lamp contacts secured to the second side of the backplate and extending into the box-like light-transmitting formed by the backplate and the lens, in combination;

(d) a lamp connected to the lamp contacts, wherein the lamp is completely enclosed by the backplate and the lens, in combination, and wherein the lamp/lens assembly can be supported by securing either the first side or the second side, or both sides, of the backplate to a supporting structure using wood screws;

(e) the backplate second side forms an aperture for admitting the lamp contacts into the interior of the box-like light-transmitting structure;

(f) the backplate second side comprises a ridge adjacent the aperture; and (g) each lamp contact comprises a plurality of locking elements which engage the ridge to lock the contact in place.

5. The light fixture of claim 4, wherein the ridge has a pair of opposing, substantially parallel sides, and the lamp contact locking elements comprise a stop, for engaging one side of the ridge, and a leaf spring element for engaging the opposite, substantially parallel side of the ridge.

6. The light fixture of claim 4, wherein one wall of the lens forms a fresnel lens.

7. The light fixture of claim 4, wherein the backplate second side is about 1½ inches deep and the backplate first side is about 3½ inches high, whereby the lamp/lens assembly can be flush mounted to 2-by-4 and 4-by-4 supporting structures in a variety of ways.

8. A light fixture suitable for connection to a deck member, comprising:

(a) a support structure suitable for connection to the deck member;

(b) a lamp/lens assembly comprising:

(i) a backplate suitable for connection to the support structure, the backplate comprising first and second substantially perpendicular sides, and the support structure comprising a post suitable for connection to the deck member, wherein the first side of the backplate is configured for removable connection to the post;

(ii) a pair of lamp contacts operatively supported by the backplate;

(iii) a lamp mechanically and electrically connected to the lamp contacts; and (iv) a lens removably connected to the backplate, wherein the backplate can be connected from the support structure or disconnected from the support structure and connected directly to the deck member; and (c) the support structure further comprising a stake removably connected to the bottom of the post, the stake being suitable for insertion into the ground.

9. A lamp/lens assembly for a light fixture, comprising:

(a) a plastic backplate having first and second generally perpendicular sides, each side being apertured to receive wood screws;

(b) a four-sided light-transmitting plastic lens removably connected to the backplate, wherein the backplate and the lens combine to form a plastic box-like light-transmitting structure;

(c) a pair of lamp contacts secured to the second side of the backplate and extending into the box-like light-transmitting formed by the backplate and the lens, in combination;

(d) a lamp connected to the lamp contacts, wherein the lamp is completely enclosed by the backplate and the lens, in combination, and wherein the lamp/lens assembly can be supported by securing either the first side or the second side, or both sides, of the backplate to a supporting structure using wood screws; and (e) the lamp/lens assembly further comprises an electrical cable connected to the lamp contacts, and a channel is formed along the intersection line of the substantially perpendicular backplate sides, wherein the channel accepts the cable and allows the cable to enter at either lateral edge of the lamp/lens assembly.

* * * * *